US006070765A

United States Patent [19]

Holzboog

[11] Patent Number: 6,070,765

[45] Date of Patent: Jun. 6, 2000

[54] TAMPERING INDICATING COVER FOR AEROSOL VALVE

[75] Inventor: Walter Holzboog, Ballwin, Mo.

[73] Assignee: Delta Industries, Inc., St. Louis, Mo.

[21] Appl. No.: 09/098,659

[22] Filed: Jun. 17, 1998

[51] Int. Cl.[7] ..... B67B 5/00; B67D 5/32; B67D 5/378

[52] U.S. Cl. ..... 222/153.06; 222/153.07; 222/153.1; 220/276; 220/724; 220/915; 215/254; 215/256

[58] Field of Search ..... 222/153.06, 153.07, 222/153.1; 215/254, 256; 220/276, 724, 915

[56] References Cited

U.S. PATENT DOCUMENTS

| | | | |
|---|---|---|---|
| 3,028,992 | 4/1962 | Bucher et al. | 220/27 |
| 3,037,672 | 6/1962 | Gach | 220/915 |
| 3,684,124 | 8/1972 | Song | 222/153.07 |
| 3,955,716 | 5/1976 | Goncalves | 215/256 |
| 4,962,864 | 10/1990 | Appal et al. . | |
| 5,540,342 | 7/1996 | Rathburn | 215/256 |
| 5,722,568 | 3/1998 | Smith . | |

*Primary Examiner*—Steven O. Douglas
*Assistant Examiner*—Timothy L. Maust
*Attorney, Agent, or Firm*—Polster, Lieder, Woodruff & Lucchesi

[57] ABSTRACT

An aerosol valve cover (10) having a generally cup-shaped plastic body (12) with a cylindrical base wall for releasable attachment to an annular collar (52) of an aerosol valve mounting cup (51), a plurality of locking tabs (56A, 56B, 58A, 58B) carried by the base wall (16) extending inwardly from the base wall for locking receipt beneath a lower edge (50) of the annular collar, a plurality of preweakened score lines (32) in the base wall (16) to enable the base wall (16) to resiliently flex radially outwardly to be press fit down onto the annular collar (52) until the locking tabs resiliently pass over the edge and snap radially inwardly into locking receipt beneath the lower edge of the annular collar (52). An unlocking member (34) releasably attached to the base wall (16) at a break-away section (24) with an elongate neck (36) extending outwardly from the break-away section (24) to a distal manually engagable end (38) which is cantilever supported by the elongate neck (36).

22 Claims, 3 Drawing Sheets

TAMPERING INDICATING COVER FOR AEROSOL VALVE

FIELD OF THE INVENTION

This invention generally relates to a valve actuation preventing aerosol valve cover and, more particularly, to such an aerosol valve cover that locks to the valve to prevent detachment from the valve without permanent detachable alteration to the cover.

DISCUSSION OF THE RELEVANT PRIOR ART

Many food products and other products are contained within aerosol containers. The product, such as whipped cream or the like, is contained within the container together with a gaseous propellant under pressure. When an aerosol valve attached to the container is actuated into an open position, then the pressure of the aerosol propellant forces the product to be dispensed out of the container through the valve, if the container is held in a downward orientation with the valve located at a level beneath the bottom of the container. However, if the valve is opened with the container in an upright orientation, then the propellant rises to the top of the container and escapes through the valve. Once the propellant has escaped from the container it is no longer possible to dispense the product through the valve.

In order to prevent inadvertent actuation of the valve during shipping, stocking of store shelves with the containers and general handling of the container prior to intended use by the consumer, manufacturers have provided valve actuation preventing valve covers that are releasably attached to and protectively cover the valve actuators at the top of the containers.

An unfortunate problem encountered by manufacturers of such aerosol containers is that persons with substance abuse problems are known to enter stores where the aerosol containers are sold to the public, and intentionally remove the actuation preventing valve covers and actuate the valves with the container in an upright position in order to inhale the escaping propellant gas into their lungs to obtain a chemically induced intoxication. Such persons are known to then re-attach the covers to the containers and replace them on the shelf. Neither the operator of the retail store before the purchase nor the subsequent purchaser at the time of purchase of the tampered container are able to discern from visual inspection that the cover has been removed. Consequently, the tampered container is left on the shelf until an unsuspecting customer buys the tampered container. The absence of propellant in the tampered container is then not discovered until the consumer attempts to dispense the product from the container and is unable to do so.

This naturally results in consumer dissatisfaction with the manufacturer's product and the retail store from which the product was purchased and damage to their good will and reputation. If the consumer returns the defective tampered container, then the store will customarily obtain a credit for its return to the manufacturer, presuming the lack of propellant is due to an original manufacturing defect.

An actuation preventing aerosol valve cover has been developed to address this problem that is known as the TAMP-R-GARD™ cover. This known cover is locked to the valve by means of an annular wall at the base of the cover with radially, inwardly extending tabs that are received beneath the peripheral, circular edge of a valve mounting cup at the top of the container. The tabs block longitudinal movement relative to the valve and to the protectively contained valve actuator. A reinforcement tab is attached at one end to a section of the annular wall, which is separated along its circumferential, upper edge from the body. The other end is detachably connected at its other end to the remainder of the annular wall that is not separated from the body of the cup. The reinforcement tab is intended to reinforce the annular wall and tighten the separated section of the annular wall against sufficient radially outward distortion to enable removal of the tabs out from beneath the peripheral edge of the mounting cup and detachment of the cover.

The entire cup is integrally formed of molded polypropylene plastic, and the end of the reinforcement tab is molded to the remainder of the annular wall that is not separated from the body of the cover by a pair of relatively thin joints. These joints are broken to release the reinforcement provided to the annular wall by the reinforcement tab to enable detachment of the cover from the valve. Accordingly, the broken joints provide a visually detectable "tell-tale" that the cover may have been removed.

Disadvantageously, the design of this known "tell-tale" cover does not entirely enable fulfillment of its intended function. There are only three tabs, and one of them is carried by the elongate section of the annular wall that is separated from the body of the cover by an elongate slot. Because the separated section of the annular wall is elongate and carries one of the only three tabs it is relatively flexible in the radial direction and can be pried or otherwise radially moved outwardly sufficiently to enable detachment of the cover from the valve without breaking the "tell-tale" joints. In addition, the reinforcement tab is generally congruent with the circular surface of the annular wall such that, even after the joints are broken, the breakage of the joints is hidden from view by the outer surface of the reinforcement tab when seen from a lateral position which is the normal viewing angle when the container is resting on a store or cabinet shelf. Further, because the reinforcement tab has to be removed by peeling it away from the side of the annular wall, no leverage or other mechanical advantage is obtained, and intended breakage of the joints is relatively difficult to perform by the consumer.

SUMMARY OF THE INVENTION

Accordingly, it is the primary object of the present invention to provide an aerosol valve cover which overcomes the disadvantages of the known cover with respect to preventing locked removal, visibility of tampering and ease of unlocking the cover.

This object is achieved by provision of an aerosol valve cover for releasable attachment to an annular collar of an aerosol valve mounting cup having a generally cup-shaped, resilient, plastic body with a generally cylindrical base wall with a plurality of locking tabs carried by and extending radially inwardly from the base wall for locking receipt beneath a lower edge of the annular collar of the aerosol valve mounting cup, a plurality of preweakened score lines in the base wall at least two of which are located on opposite sides of at least one of the plurality of locking tabs to enable the base wall to resiliently flex radially outwardly sufficiently to be press fit down onto the annular collar until the locking tabs resiliently pass over the edge and snap radially inwardly into locking receipt beneath the lower edge, and means for permanently altering the base wall to enable radially outward expansion of the base wall to move the locking tabs out from beneath the lower edge to allow detachment of the body from the collar.

Also, the object is partly obtained by providing an aerosol valve cover for releasable attachment to an annular collar of an aerosol valve mounting cup having a cup-shaped body with a closed top and open bottom with a base wall having a top and a bottom with a break-away section of the base wall having an unlocking member with an elongate neck extending substantially outwardly from one end attached to the break away section to a distal, manually engageable end that is cantilever supported by the elongate neck at a location outwardly spaced from the base wall.

BRIEF DESCRIPTION OF THE DRAWING

The foregoing objects and advantageous features of the invention will be explained in greater detail and others will be made apparent from the detailed description of the preferred embodiment of the present invention, which is given with reference to the several figures of the drawing, in which.

DESCRIPTION OF THE PREFERRED EMBODIMENT

Figure 1:
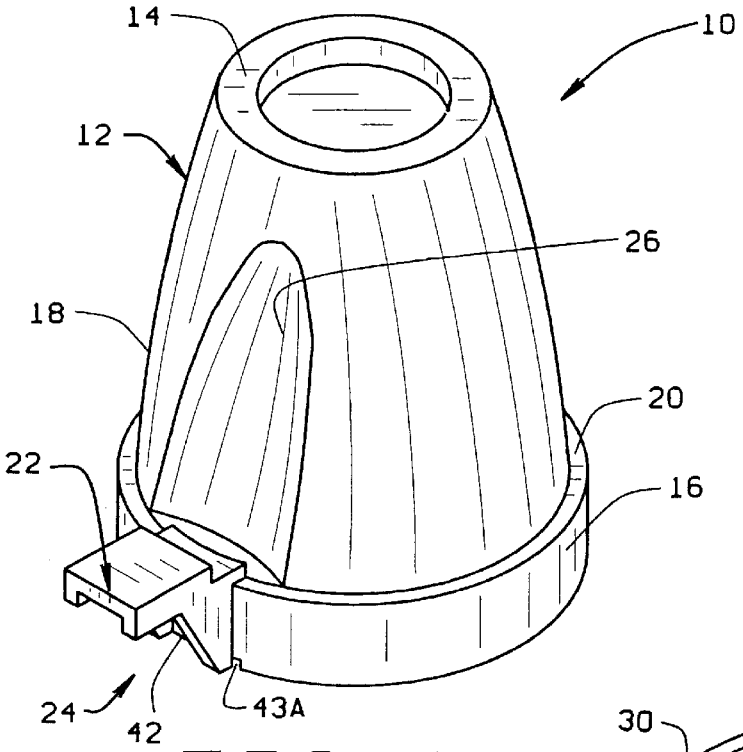
FIG. 1 is a perspective view of a preferred embodiment of the aerosol valve cover of the present invention.

Referring to FIG. 1, the preferred embodiment of the aerosol valve cover 10 of the present invention is seen to have a generally cup shaped resilient plastic body 12. The body 12 has a circular top 14, a cylindrical base wall 16 and a inwardly tapered surface 18 extending between a top 21 of the base wall 16 with a top edge 20 integrally joined at and truncated by the circular top 14. An unlocking assembly 22 is releasably attached to the base wall 16 at a break-away section 24.

Figure 2:
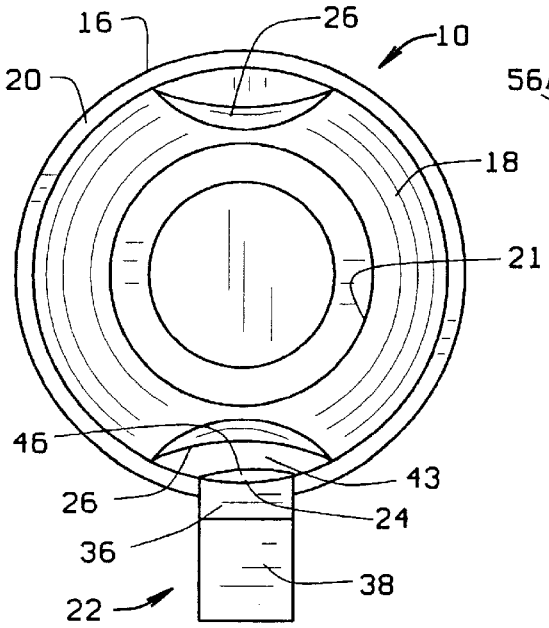
FIG. 2 is a plan view of the aerosol valve cover of FIG. 1.

Referring now to FIG. 2, formed in the tapered surface 18 are a pair of arch shaped arcuate depressions 26 which are located opposite one another and extend between the circular top 14 and the top edge 20 of the base wall 16. The arch shaped arcuate depressions 26 enhance the radial rigidity of the cylindrical tapered surface 18 to disable removal of the valve cover 10 without removal of the unlocking assembly 22.

Figure 3:
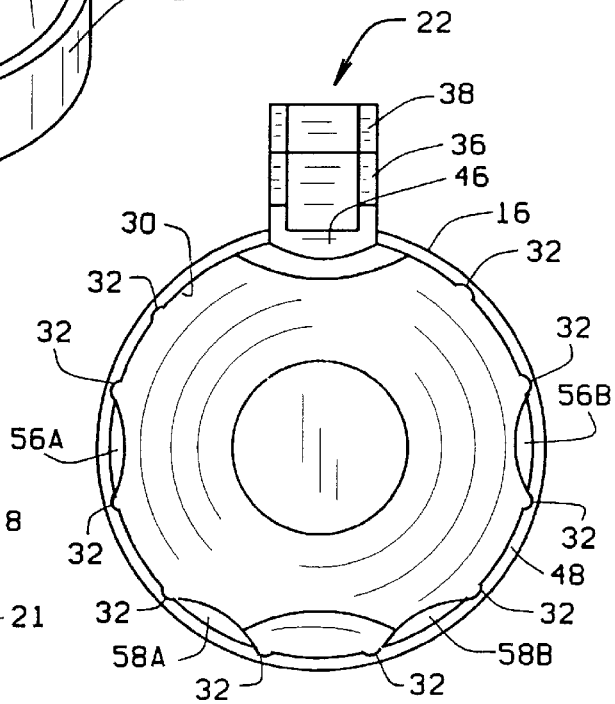
FIG. 3 is a bottom view of the aerosol valve cover of FIG. 1.

Referring also to FIG. 3, formed in the base wall 18 are ten preweakened score lines 32 that are equally spaced 30 along the base wall 18 to relatively enhance radial flexibility around the interior surface of the base wall 16 relative to the other portions of the body 12. The score lines 32, having a substantially U-shaped cross section to allow sufficient radially outward expansion of the base wall to enable the base to be press fit down onto a valve mounting cup 54, and reduce the possibility of sufficient distortion to enable removal of the cover 10 from an aerosol valve without actuation of the unlocking assembly 22.

Figure 4:
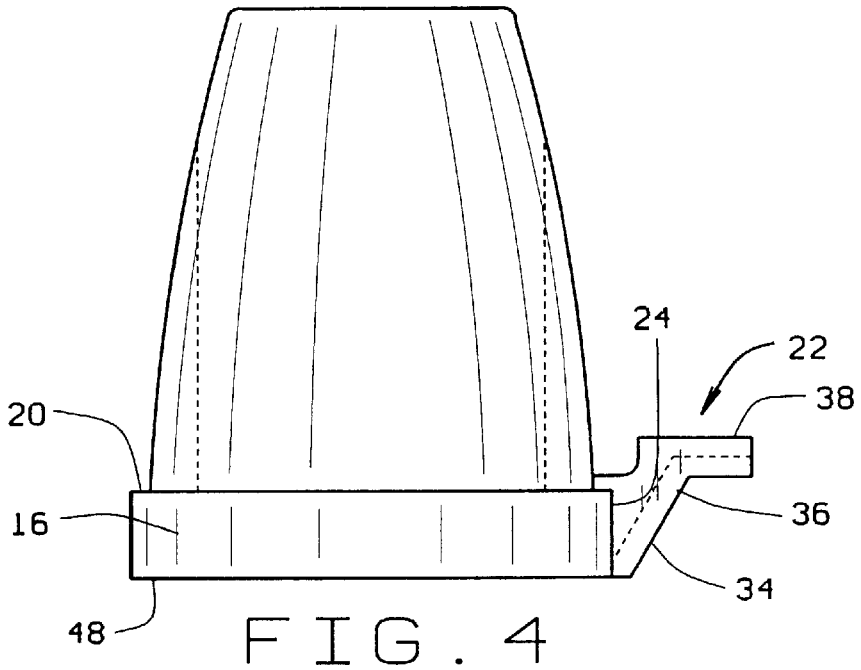
FIG. 4 is a side elevation view of the aerosol valve cover of FIG. 1.

Referring now to FIG. 4 the unlocking assembly 22 includes an unlocking member 34 that is cantilever mounted to the cylindrical base wall 16. The member 34 includes a neck 36 that extends upwardly and outwardly from the break-away section 24 of the base wall 16 to a distal manually engageable end 38. The manually engageable end 38 has an upwardly facing horizontal, planar engagement surface that is supported at the distal end of a neck 36 and is located between the top 20 of the base wall 16 and the circular top 14 of the cup shaped body 12 to provide enhanced side visibility.

Figure 5A:
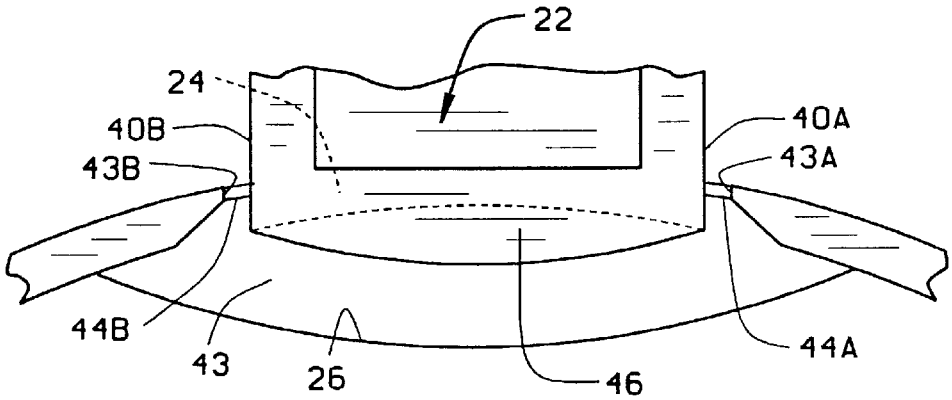
FIG. 5A is an enlarged view taken along circle V of FIG. 3.
Figure 5B:
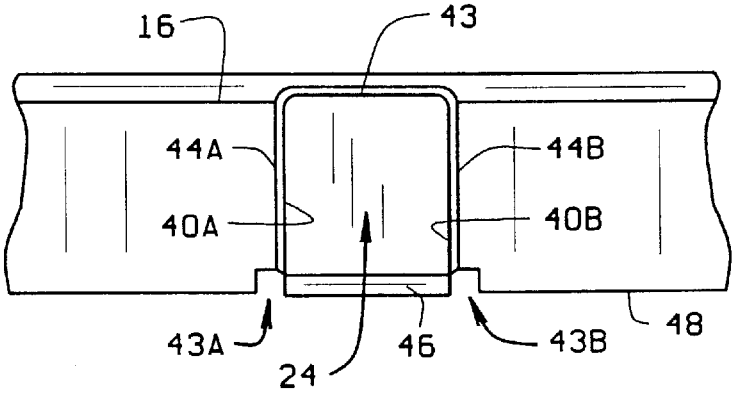
FIG. 5B is a detail view corresponding to FIG. 5A from the inside of the aerosol valve cover of FIG. 1.

Referring now to FIG. 5A and FIG. 5B the break-away section 24 has a pair of opposite sides 40A and 40B and is located below a break-away opening 43 located in the base wall 16, as seen particularly in FIG. 5A. A pair of preweakened break-away score lines 44A and 44B are located adjacent the pair of sides 40A and 40B of the break-away section 24, respectively, to define the break-away section 24. A locking tab 46 having a substantial arcuate shape is integrally formed with the bottom of the break-away section 24 and extends across the width of the unlocking member between the pair of opposite sides 40A and 40B. As shown particularly in FIG. 5B, adjacent the pair of opposite sides 40A and 40B are a pair of breakaway slots 43A and 43B, formed in a bottom edge 48 of the base wall 16, which help facilitate the removal of the unlocking assembly.

Accordingly, when the manually engageable end 38 is pushed downwardly toward the bottom edge 48 of the base wall 16, the break-away section 24 tears away from the base wall 16 along the pair of slots 43A and 43B and along the break-away score lines 44A and 44B until the break-away section 24 is substantially entirely removed from the base wall 16 adjacent the break-away score lines 44A and 44B. Removal of the unlocking member 34 from the break-away section 36 creates a rectangular breakaway opening extending from the opening 43 along the score line 44A to the bottom edge 48 of the base wall 16 at break-away slot 43A, and extending from the opening 43 along the score line 44B to the bottom edge 48 of the base wall 16 at break-away slot 43B. With the unlocking member 22 substantially removed from the base wall, the base wall 16 is enabled to distort radially outwardly to unlock the base wall 16 from the aerosol valve mounting cup 54.

Figure 6:
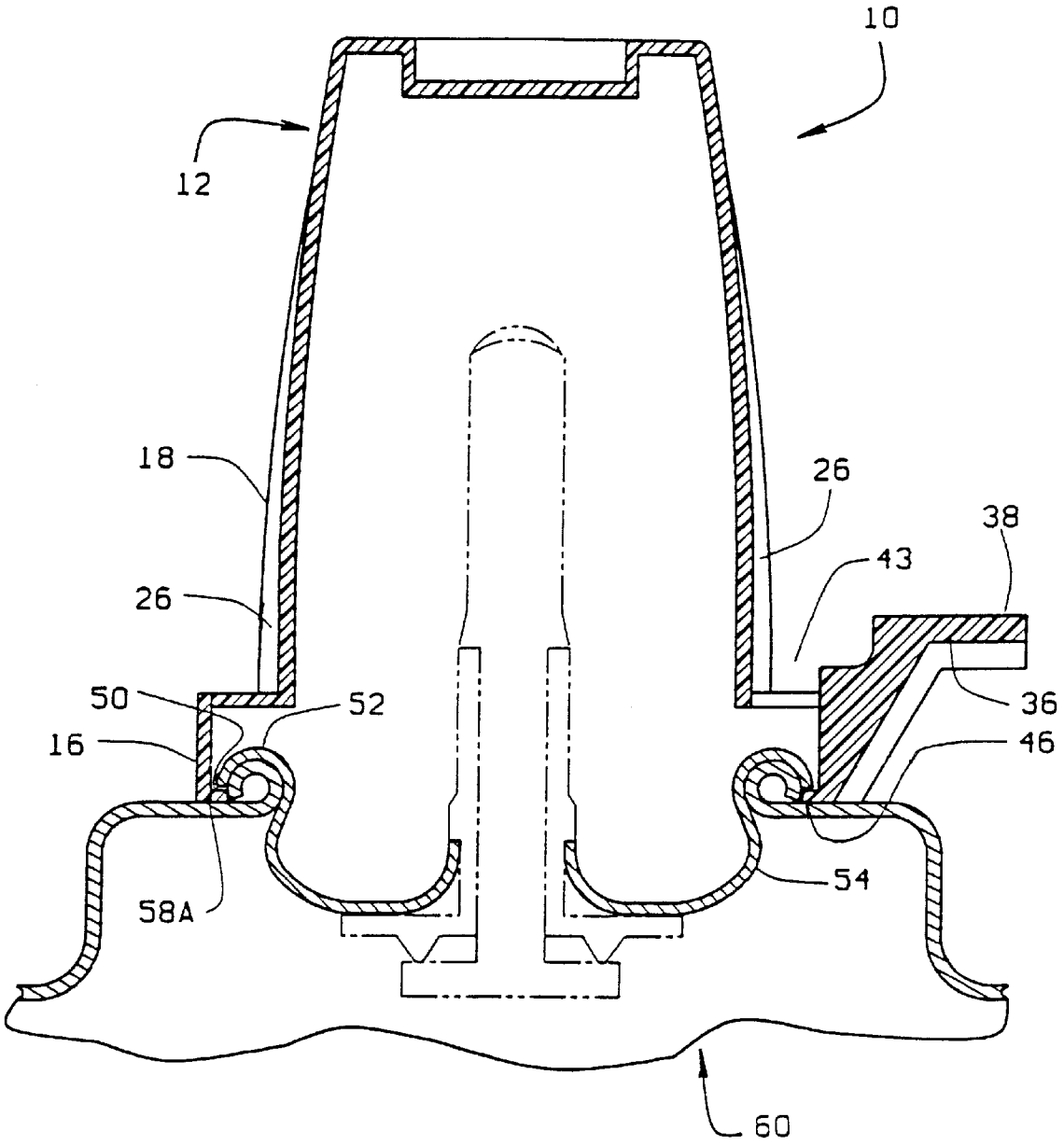
FIG. 6 is a cross sectional, side elevational view of the cover of FIG. 1 taken along section line IV—IV of FIG. 2 as locked to an aerosol valve.

Referring also to FIG. 6, the base wall 16 at its bottom edge 48 carries five equally spaced locking tabs dispersed about the bottom edge 48 which extend radially inwardly for underlying locking receipt beneath the bottom edge 50 of an annular collar 52 of the valve mounting cup 54. As shown in FIG. 3 one pair of locking tabs 56A and 56B are located on opposite sides of the break-away section while another pair is 58A and 58B are located substantially opposite the break-away section. The fifth locking tab 46 is carried by the break-away section 24 itself, and has a width equal to the width of the break-away section 24. The ten equally spaced, parallel, preweakened, score lines 32 are positioned adjacent the tabs 56A, 56B, 58A, and 58B and midway between the tabs 56A and 56B and tab 46. These score lines 32 enable the base wall to be distorted sufficiently to enable locking of the valve cover 10 to the aerosol valve 60 by pressing it down onto the annular collar 52 until the tabs 46, 56A, 56B, 58A, and 58B pass the bottom edge 50 and resiliently snap inwardly into underlying locking relationship with respect to the bottom edge 50, as best seen in FIG. 6. The tab 46 located on the break-away section 24 is accessible through the break-away opening 43, but, as shown particularly in FIG. 6, is too large to enable prying the tab 46 out of locking relationship with the collar 52 without also breaking the unlocking member 34 away from the base wall 16.

The cover 10 cannot be pulled off the collar 52 because grabbing the body wall 18 in order to pull on the cover also results in squeezing the tabs 46, 56A, 56B, 58A, and 58B radially inwardly into more secure locking relationship with the collar 52. Thus, while the preweakened, score lines enable sufficient outward distortion to enable snap fitting the base wall 16 to the collar 52, they do not permit sufficient outward distortion to enable removal from the collar 52 once it has been locked in place.

While a detailed description of the preferred embodiment of the invention has been given, it should be appreciated that many variations can be made thereto without departing from the scope of the invention as set forth in the appended claims.

What is claimed is:

1. An aerosol valve cover for releasable attachment to an annular collar of an aerosol valve mounting cup, comprising:

a generally cup-shaped, resilient, plastic body with a generally cylindrical base wall;

a plurality of locking tabs carried by and extending radially inwardly from the base wall for locking receipt beneath a lower edge of the annular collar of the aerosol valve mounting cup;

more than two vertical preweakened score lines in the base wall, extending to a lower edge of the base wall, at least two of the score lines being located on opposite sides of at least one of the plurality of locking tabs to enable the base wall to resiliently flex radially outwardly sufficiently to be press fit down onto the annular collar until the locking tabs resiliently pass over the annular collar and snap radially inwardly into locking receipt beneath the lower edge of the annular collar; and means for permanently altering the base wall to enable radially outward expansion of the base wall to move the locking tabs out from beneath the lower edge of the annular collar to allow detachment of the body from the collar.

2. The aerosol valve cover of claim 1 in which the plurality of score lines are equidistantly spaced around a periphery of the base wall to enhance substantially uniform radial flexibility around the base wall relative to other portions of the body.

3. The aerosol valve cover of claim 1 in which the permanently altering means includes a tear-away section, having a pair of opposite sides, and said plurality of score lines further includes a pair of score lines on the opposite sides of the tear-away section for facilitating removal of the tear-away section.

4. The aerosol valve cover of claim 1 wherein the plurality of locking tabs include five locking tabs equidistantly spaced around the periphery of the base wall.

5. The aerosol valve cover of claim 1 wherein the plurality of preweakening score lines include ten score lines equidistantly spaced around the periphery of the base wall.

6. The aerosol valve cover of claim 1 in which said score lines have a generally U-shaped cross section.

7. The aerosol valve cover of claim 1 in which the score lines are located on an interior surface of the base wall.

8. The aerosol valve cover of claim 3 including a manually engageable member on the tear-away section for actuating removal of the tear-away section from the base wall.

9. The aerosol valve cover of claim 8 including a locking tab on the tear-away section, the locking tab on the tear-away section having a width substantially equal to a width of the tear-away section.

10. An aerosol valve cover for releasable attachment to an annular collar of an aerosol valve mounting cup, comprising;

a cup-shaped body with a closed top and open bottom;

a generally cylindrical base wall having a top and a bottom;

a break-away section of the base wall; and an unlocking member with an elongate neck extending substantially upwardly and outwardly from one end attached to the break-away section to a distal, manually engageable end that is cantilever supported by the elongate neck at a location outwardly spaced from the base wall.

11. The aerosol valve cover of claim 10 in which the elongate neck extends upwardly and outwardly from the base wall.

12. The aerosol valve cover of claim 10 in which the manually engageable end has a manual actuator with an engagement surface facing upwardly.

13. The aerosol valve assembly of claim 11 in which the distal end of the neck supports the actuator at a location between the top of the base wall and the top of the cup-shaped body.

14. The aerosol valve cover of claim 10 in which a locking tab is carried by the break-away section.

15. The aerosol valve cover of claim 10 in which the break-away section is defined by a pair of score lines on opposite sides of the unlocking member.

16. The aerosol valve cover of claim 15 in which the unlocking member forms an opening in the top of the base wall at the break-away section.

17. The aerosol valve cover of claim 15 in which the unlocking member forms a slot in the bottom of the base wall at the break-away section.

18. The aerosol valve cover of claim 16 in which the unlocking member is torn along the score lines and completely removed from the breakaway section.

19. The aerosol valve cover of claim 10 in which the cup-shaped body has a tapered cylindrical surface extending between the top of the base wall and the top of the cup-shaped body.

20. An aerosol valve cover for releasable attachment to an annular collar of an aerosol valve mounting cup, comprising:

a cup-shaped body with a closed top and open bottom;

a base wall having a top and a bottom;

a break-away section of the base wall; and an unlocking member with an elongate neck extending substantially outwardly from one end attached to the break away section to a distal, manually engageable end that is cantilever supported by the elongate neck at a location outwardly spaced from the base wall, the cup-shaped body having a generally conical wall attached to the top of the base wall and a vertical depression in the conical wall forming an opening in the top of the base wall above the breakaway section.

21. The aerosol valve cover of claim 20 in which at least a pair of locking tabs are located on opposite sides of the break-away section.

22. The aerosol valve cover of claim 21 in which a second vertical depression in the conical wall is located substantially opposite the break-away section.

* * * * *